US007681744B2

(12) United States Patent
Johnson

(10) Patent No.: US 7,681,744 B2
(45) Date of Patent: Mar. 23, 2010

(54) MERCHANDISING SYSTEM

(75) Inventor: Allen E. Johnson, Hartford, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 671 days.

(21) Appl. No.: 10/557,571

(22) PCT Filed: May 21, 2004

(86) PCT No.: PCT/US2004/016062

§ 371 (c)(1),
(2), (4) Date: Dec. 19, 2006

(87) PCT Pub. No.: WO2004/105556

PCT Pub. Date: Dec. 9, 2004

(65) Prior Publication Data

US 2007/0170127 A1 Jul. 26, 2007

Related U.S. Application Data

(60) Provisional application No. 60/472,955, filed on May 22, 2003, provisional application No. 60/473,350, filed on May 22, 2003.

(51) Int. Cl.
*A47F 1/04* (2006.01)

(52) U.S. Cl. ..... 211/59.3

(58) Field of Classification Search ..... 211/59.3, 211/59.2, 189, 193, 126.5, 133.3, 86.01, 211/87.01

See application file for complete search history.

(56) References Cited

U.S. PATENT DOCUMENTS

| | | | |
|---|---|---|---|
| 870,993 | A | 11/1907 | Richardson |
| 903,368 | A | 11/1908 | Flanders |
| 1,030,317 | A | 6/1912 | Middaugh |
| 1,117,255 | A | 11/1914 | Schmidt |
| 1,750,575 | A | 3/1930 | Cubberley |
| 2,079,754 | A | 5/1937 | Waxgiser |
| 2,110,299 | A | 3/1938 | Hinkle |
| 2,303,275 | A | 11/1942 | Hull |
| 2,625,162 | A | 1/1953 | Edeborg |
| 2,652,154 | A | 9/1953 | Stevens |
| 3,161,295 | A | 12/1964 | Chesley |
| 3,308,961 | A | 3/1967 | Chesley |
| 3,348,732 | A | 10/1967 | Schwarz |
| 3,452,899 | A | 7/1969 | Libberton |
| 3,893,585 | A | 7/1975 | Morrison et al. |
| 4,130,203 | A | 12/1978 | Russell, III |
| 4,300,693 | A | 11/1981 | Spamer |
| 4,330,955 | A | 5/1982 | Rabas |
| 4,337,588 | A | 7/1982 | Clapper |
| 4,378,872 | A | 4/1983 | Brown |

(Continued)

*Primary Examiner*—Jennifer E. Novosad
(74) *Attorney, Agent, or Firm*—Brian G. Gilpin; Godfrey & Kahn, S.C.

(57) ABSTRACT

A merchandising system for articles comprising a base comprising an upper surface having a plurality of ribs, an underside having a plurality of supports formed integrally with the underside of the base, and a first side and a second side. The merchandising system comprises a frame coupled to the base and configured to couple with a shelving system for supporting the base in a substantially horizontal configuration, a first guide and a second guide coupled to the base for supporting articles, and an assembly for advancing the articles that is coupled to the base and provides force on the articles.

21 Claims, 11 Drawing Sheets

U.S. PATENT DOCUMENTS 4,401,323 A 8/1983 Rex
4,438,993 A 3/1984 Rabas
D277,154 S 1/1985 Nasgowitz
4,496,127 A 1/1985 Nelson
4,598,838 A 7/1986 Zakrajsek
4,600,121 A 7/1986 Falk et al.
4,625,894 A 12/1986 James et al.
4,632,412 A 12/1986 Nasgowitz
4,640,029 A 2/1987 Hornblad et al.
D289,458 S 4/1987 Zakrajsek
4,663,872 A 5/1987 Finger
4,685,574 A 8/1987 Young et al.
D293,984 S 2/1988 Finger
4,724,968 A 2/1988 Wombacher
4,730,741 A 3/1988 Jackle, III et al.
4,759,470 A 7/1988 Jacobs
4,762,236 A 8/1988 Jackle, III et al.
4,807,779 A 2/1989 Clapper
4,830,201 A 5/1989 Breslow
4,836,390 A 6/1989 Polvere
4,856,659 A 8/1989 Krebs
4,874,099 A 10/1989 Arnott et al.
4,901,869 A 2/1990 Hawkinson et al.
4,934,645 A 6/1990 Breslow
4,937,962 A 7/1990 Hornblad
4,948,004 A 8/1990 Chich
5,012,936 A 5/1991 Crum
5,038,970 A 8/1991 Chich
5,069,349 A 12/1991 Wear et al.
5,097,962 A 3/1992 Eklof et al.
5,114,021 A 5/1992 Fredrickson
5,123,546 A 6/1992 Crum
5,161,702 A 11/1992 Skalski
5,190,186 A 3/1993 Yablans et al.
5,199,584 A 4/1993 Fowler et al.
5,220,739 A 6/1993 Chich et al.
5,222,608 A 6/1993 Eklof
5,240,126 A 8/1993 Foster et al.
5,255,802 A 10/1993 Krinke et al.
5,265,738 A 11/1993 Yablans et al.
5,295,593 A 3/1994 Sturm
5,366,099 A 11/1994 Schmid
5,368,191 A 11/1994 Johnson
5,412,547 A 5/1995 Hornblad et al.
5,413,229 A 5/1995 Zuberbuhler et al.
5,435,463 A 7/1995 Hodgson
5,450,969 A 9/1995 Johnson et al.
5,469,976 A 11/1995 Burchell
5,485,929 A 1/1996 Danon
5,490,600 A 2/1996 Bustos
5,542,552 A 8/1996 Yablans et al.
5,547,306 A 8/1996 Zakrajsek
5,577,623 A 11/1996 Bustos
5,581,852 A 12/1996 Zakrajsek
5,593,048 A 1/1997 Johnson
5,634,564 A 6/1997 Spamer et al.
5,638,963 A 6/1997 Finnelly et al.
5,665,304 A 9/1997 Heinen et al.
5,671,851 A 9/1997 Johnson et al.
5,673,801 A 10/1997 Markson
5,685,664 A 11/1997 Parham et al.
5,746,328 A 5/1998 Beeler et al.
5,769,248 A 6/1998 Johnson
5,788,091 A 8/1998 Robertson et al.
5,806,690 A 9/1998 Johnson et al.
5,829,580 A 11/1998 Schroeter
5,839,588 A 11/1998 Hawkinson
5,855,281 A 1/1999 Rabas
5,855,283 A 1/1999 Johnson
5,873,489 A 2/1999 Ide et al.
5,970,887 A 10/1999 Hardy
5,985,413 A 11/1999 Boyle et al.
5,992,652 A 11/1999 Springs
5,992,653 A 11/1999 Anderson et al.
D418,971 S 1/2000 Scungio
6,041,720 A 3/2000 Hardy
6,082,558 A 7/2000 Battaglia
6,105,791 A 8/2000 Chalson et al.
6,129,218 A 10/2000 Henry et al.
6,131,748 A 10/2000 Kawasaki et al.
6,142,317 A 11/2000 Merl
6,155,437 A 12/2000 Rassent
6,158,598 A 12/2000 Josefsson
6,168,032 B1 1/2001 Merl
6,193,079 B1 2/2001 Wiemer
6,210,017 B1 4/2001 Miura et al.
6,227,385 B1 5/2001 Nickerson
6,273,281 B1 8/2001 Berglund
6,290,077 B2 9/2001 Sosso
6,311,852 B1 11/2001 Ireland
6,357,606 B1 3/2002 Henry
D455,519 S 4/2002 Luedecke et al.
6,375,015 B1 4/2002 Wingate
6,382,431 B1 5/2002 Burke
6,401,942 B1 6/2002 Eckert
6,409,028 B2 6/2002 Nickerson
6,454,122 B1 9/2002 Luedecke
D463,728 S 10/2002 Johnson
D463,880 S 10/2002 Luedecke et al.
D464,907 S 10/2002 Jacobs
6,464,089 B1 10/2002 Rankin, VI
6,484,891 B2 11/2002 Burke
6,523,703 B1 2/2003 Robertson
D473,076 S 4/2003 Johnson
D474,923 S 5/2003 Johnson
D476,170 S 6/2003 Johnson
6,571,498 B1 6/2003 Cyrluk
6,585,120 B2 7/2003 Robertson
6,622,874 B1 9/2003 Hawkinson
6,666,533 B1 12/2003 Stavros
6,691,891 B2 2/2004 Maldonado
6,719,151 B2 4/2004 Close
6,719,152 B1 4/2004 Nagel et al.
6,749,168 B2 6/2004 Johnson
6,823,997 B2 11/2004 Linden et al.
D499,453 S 12/2004 Hornblad
D499,454 S 12/2004 Hornblad
D499,768 S 12/2004 Hornblad
6,886,699 B2 5/2005 Johnson et al.
6,905,039 B2 6/2005 Richter et al.
6,986,918 B2 1/2006 Jacobs
7,028,852 B2 4/2006 Johnson et al.
7,032,761 B2 * 4/2006 Nagel ..... 211/59.3
7,032,766 B2 4/2006 Luedecke et al.
7,419,062 B2 * 9/2008 Mason ..... 211/59.3
7,458,473 B1 * 12/2008 Mason ..... 211/59.3
2001/0010302 A1 8/2001 Nickerson
2002/0108916 A1 8/2002 Nickerson
2002/0179553 A1 12/2002 Squitieri
2003/0057167 A1 3/2003 Johnson et al.
2003/0061959 A1 4/2003 Johnson
2003/0085187 A1 5/2003 Johnson et al.
2003/0160060 A1 8/2003 Hornblad et al.
2003/0217980 A1 11/2003 Johnson et al.
2004/0079715 A1 4/2004 Richter et al.
2004/0084392 A1 5/2004 Richter et al.
2004/0222171 A1 11/2004 Johnson
2005/0127014 A1 6/2005 Richter et al.

* cited by examiner

FIGURE 10A
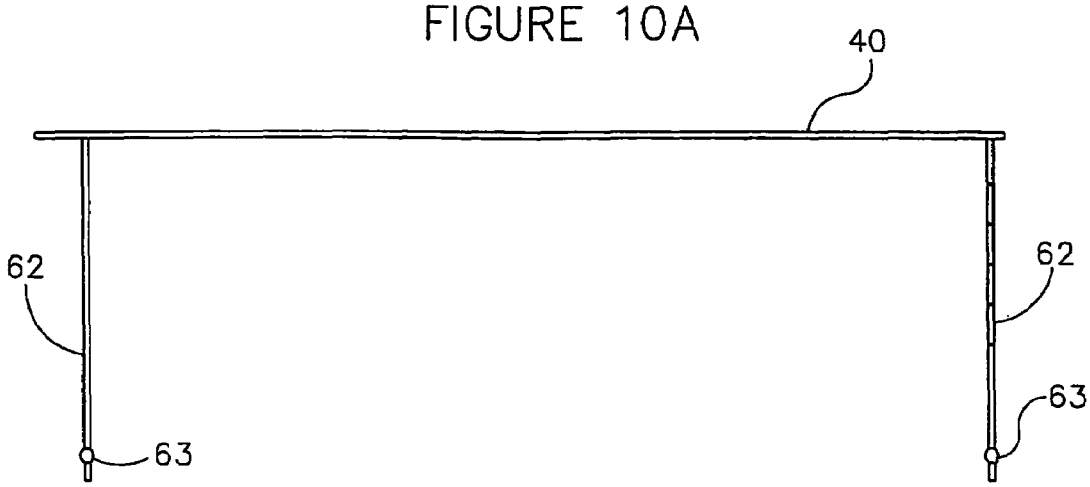
FIGURE 10B
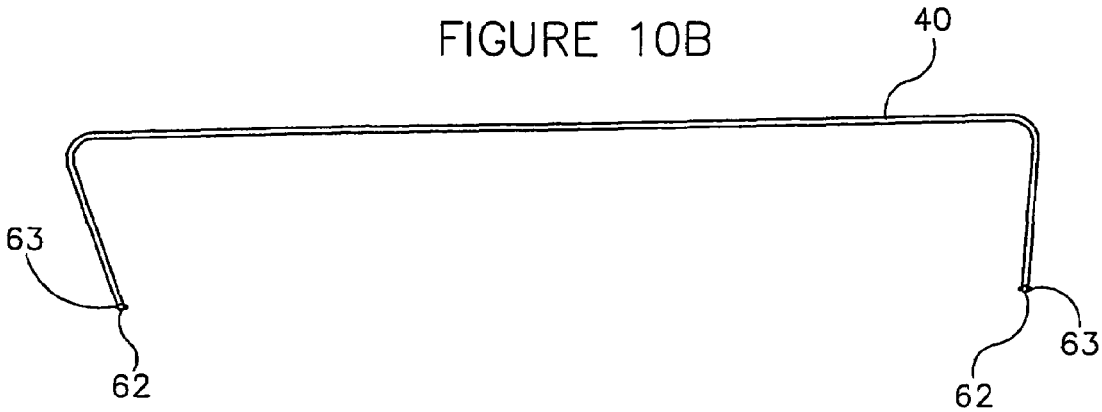
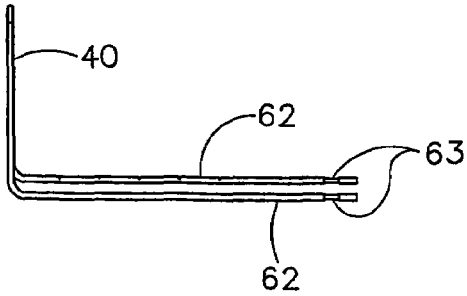
FIGURE 10C

MERCHANDISING SYSTEM

CROSS-REFERENCE TO RELATED PATENT APPLICATIONS

The present application claims the benefit of and priority as available under 35 U.S.C. §§119-121 to the following U.S. Patent Applications (which are incorporated by reference in the present Application): U.S. Provisional Patent Application No. 60/473,350 ("MERCHANDISING SYSTEM") filed May 22, 2003; U.S. Provisional Patent Application No. 60/472,955 ("MERCHANDISING SYSTEM") filed May 22, 2003.

BACKGROUND

The present invention relates generally to the field of merchandising systems. In particular, the present invention relates to merchandising systems providing for orderly presentation of articles (such as products) in a display space.

It is known to provide for a merchandising system that may be used for displaying products in consumer settings such as grocery stores, retail outlets, shops, etc. Such known merchandising systems may be used to present, display and store products in fixed or limited spaces such as on shelves, in display cases, in cabinets, etc.

It is beneficial when merchandising an article such as a product to allow potential customers to view or handle it in a convenient and comfortable manner. Known merchandising systems may display products to a consumer by providing the products in inefficient configurations. Products and product containers come in a variety of sizes and shapes, and some products may be more difficult to merchandise (e.g., present for potential retail sale) than others. Within fixed or limited spaces, known merchandising systems may not be configured to optimize the presentation of such products to a consumer. Such known merchandising systems also do not always provide convenient ways for dispensing products, especially those with unique or irregular shapes. Ease of use can be an important concern for customers and store personnel. As is sometimes the case, product or container design may be dictated by considerations separate from the ease or difficulty with which the product may be presented.

Some known merchandising systems may not provide strong and/or rigid support for articles. Accordingly, many merchandising systems may not provide articles in a straight, linear, or level arrangement due to sagging, deformation, bowing, deflection and/or movement due to the weight of the articles. Some merchandising systems fail to provide smooth, efficient gliding of an article along the length of the system. In addition, many merchandising systems may not evenly distribute weight from articles and/or product along the length of the system. This may result in a higher force when loading or stocking the unit (e.g., some spring pusher systems may require higher spring tension).

Some known merchandising systems do not provide effective means for stacking multiple trays next to one another (or in levels) without causing the trays to become tangled. For example, many systems have bulky sides often prone to tangling. This is often caused by manufacturing systems that have identical sides capable of becoming locked together because of their similar configurations.

Accordingly, it would be advantageous to provide a merchandising system that is configured for stocking, orderly presentation, and convenient storage of products with a shape that may not be easily stored, presented, or displayed, such as products with uniquely shaped containers. It would also be advantageous to provide a merchandising system that is configured for selective modularity in the construction and assembly of the merchandising system. It would also be advantageous to provide a merchandising system that allows for the construction and assembly of a merchandising system with any number of product facings, modules, compartments, etc. It would also be advantageous to provide a merchandising system that advances a product and/or allows a product to advance along a defined path. It would also be advantageous to provide a merchandising system that may withstand large vertical forces when in an extended position, a stowed position, or any position therebetween. It would also be advantageous to provide a merchandising system that may evenly distribute the weight of articles and/or products over the length of the system. It would also be advantageous to provide a merchandising system that allows for smooth, efficient gliding of articles and/or products along the length of the system. It would also be advantageous to provide a merchandising system that minimizes tangling or hooking with adjacent trays or objects.

It would be advantageous to provide a merchandising system or the like of a type disclosed in the present application that provides any one or more of these or other advantageous features.

SUMMARY

The invention relates to a merchandising system for articles. The merchandising system comprises a base comprising an upper surface having a plurality of ribs, an underside having a plurality of supports formed integrally with the underside of the base, and a first side and a second side. The merchandising system comprises a frame coupled to the base and configured to couple with a shelving system for supporting the base in a substantially horizontal configuration, a first guide and a second guide coupled to the base for supporting articles, and an assembly for advancing the articles that is coupled to the base and provides force on the articles.

The present invention also relates to merchandising system for articles comprising a base comprising an upper surface, a first side and a second side, a frame coupled to the base and having a first interface and a second interface that are configured to couple with a shelving system for supporting the base in a substantially horizontal configuration, a first guide and a second guide coupled to the base for supporting articles, and an assembly for advancing articles that is coupled to the base and provides force on the articles. The first guide comprises a first corner having an angle and the second guide comprises a first corner having an angle and the angle of the first corner of the first guide is not equal to the angle of the first corner of the second guide.

Another embodiment of the present invention relates to a merchandising system for articles comprising a base comprising an upper surface having a plurality of ribs and an under surface having a plurality of supports formed integrally with the under surface of the base, a frame coupled to the base and having a first interface and a second interface that are configured to couple with a shelving system for supporting the base in a substantially horizontal configuration, sides coupled to the base for supporting articles; and an assembly for advancing articles that is coupled to the base and provides force on the articles.

BRIEF DESCRIPTION OF THE DRAWINGS

FIG. 10A is a top plan view of a guide of a merchandising system according to an exemplary embodiment.

FIG. 10B is a side plan view of a guide of a merchandising system according to an exemplary embodiment.

FIG. 10C is a front plan view of a guide of a merchandising system according to an exemplary embodiment.

DETAILED DESCRIPTION

Referring to the FIGURES, various exemplary and alternative embodiments of a merchandising system intended for displaying articles such as products, containers, items, units, etc. in consumer settings such as grocery stores, retail outlets, shops, etc. are shown. According to a preferred embodiment, the merchandising system is intended to dispense, store, merchandise, display, etc. articles (such as packages 31 shown in FIG. 11) to provide for the space-efficient presentation of groups of articles within a given or fixed display area, and/or to allow for convenient and orderly presentation, dispensing, stocking, and storage of articles (such as products or product containers) having any of a wide variety of sizes, shapes, and profiles (e.g., wedges, cylinders, rectangular, non-rectangular, etc.).

Figure 1:
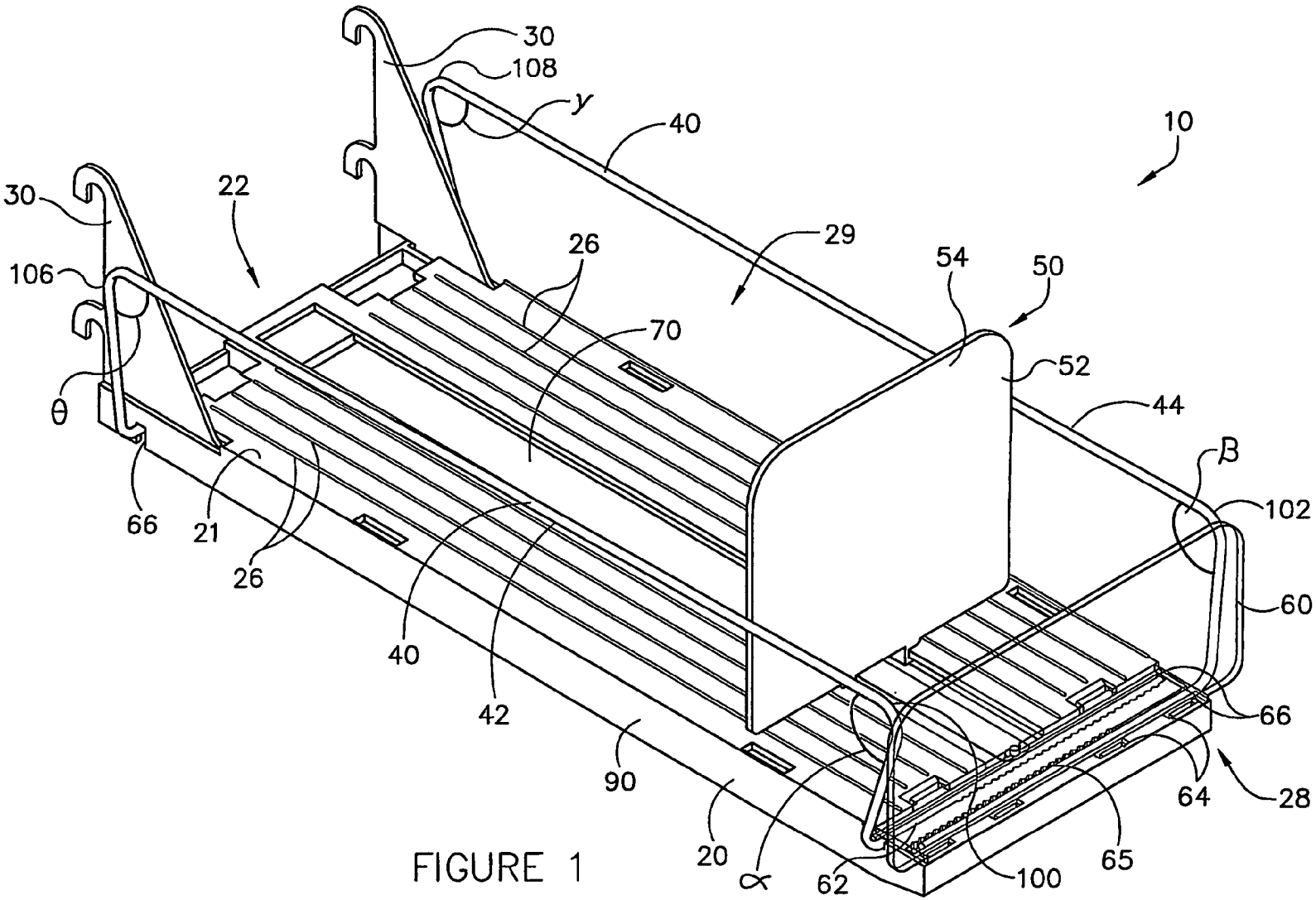
FIG. 1 is a front perspective view of a merchandising system according to an exemplary embodiment.
Figure 2:
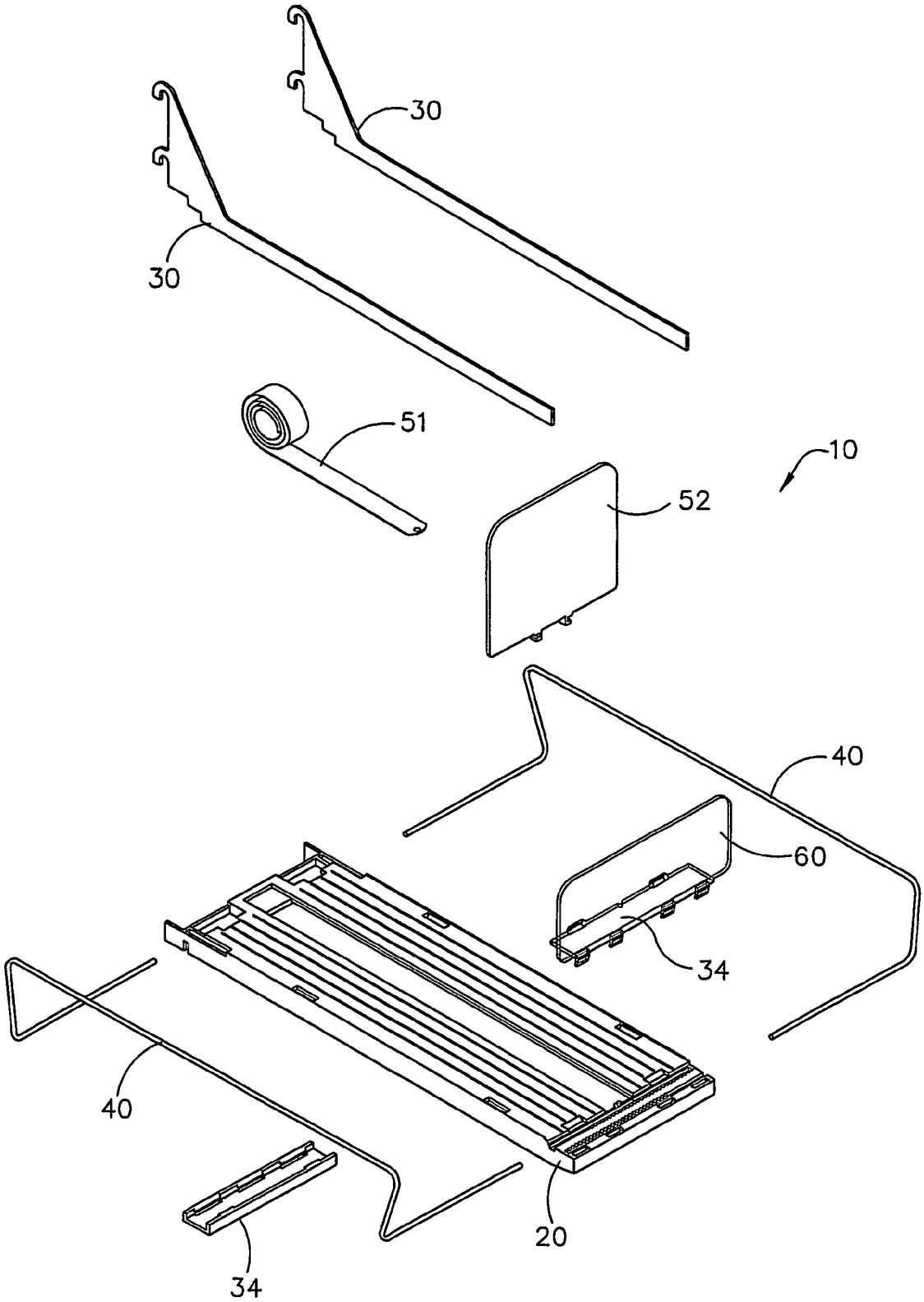
FIG. 2 is an exploded front perspective view of a merchandising system according to an exemplary embodiment.

FIGS. 1 and 2 show a merchandising system 10 (e.g., tray system, shelf system, display system, case, divider system, storage system, modular system, etc.) according to an exemplary embodiment. As shown in the FIGURES, merchandising system 10 comprises a base 20, an assembly 50, and a plate 60.

According to an exemplary embodiment shown in FIG. 1, system 10 includes base 20 (e.g., tray, floor, support, support system, panel, member, platform, etc.) having a rear end 22 (e.g., rear) and a front end 28 (e.g., front). According to an exemplary embodiment, the rear end may comprise a retaining wall (e.g., member, element, etc.). According to an exemplary embodiment shown in FIGS. 1 and 2, rear end 22 does not comprise a retaining wall and is left open. Base 20 may also include a surface 21 (e.g., floor, bottom, shelf, etc.), guides or retainers 40 (e.g., sides, side wires, bars, etc.), and plate 60 (e.g., front wall, member, element, etc.). Surface 21, retainers 40, and plate 60 are intended to create a space 29 for articles on base 20.

As shown in FIGS. 1, 2, 5, and 6, base 20 may be provided in a substantially horizontal orientation relative to a mounting structure (e.g., such as the ground, frame, grid, etc.). Base 20 may be configured to support articles such as product (e.g., merchandise, foodstuffs, boxes, containers, food products, bottles, cans, etc.) in space 29. Surface 21 may also be provided with one or more ribs 26 (e.g., protrusions, runners, spines, supports, spokes, struts, rods, ridges, etc.). Ribs 26 may act to reduce friction when sliding a product along surface 21 (e.g., less surface area than a flat surface). Ribs 26 extend over at least a portion of surface 21 of base 20. According to a preferred embodiment, base 20 includes 6 to 12 ribs on surface 21. According to alternative embodiments, any suitable number of ribs may be provided (e.g., 2, 4, 14, 20, etc.).

Figure 3:
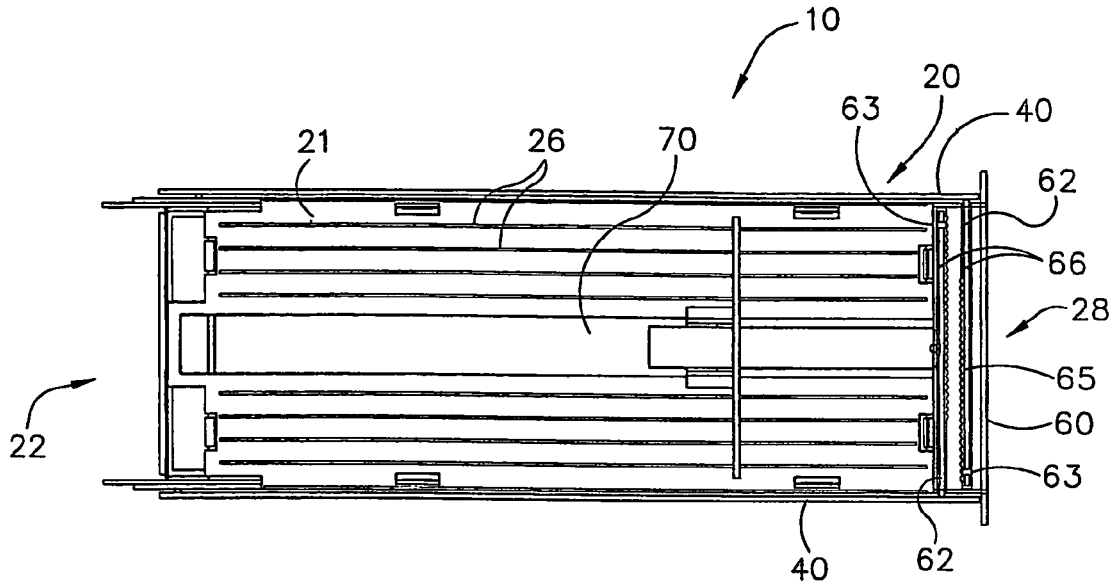
FIG. 3 is a top plan view of a merchandising system according to an exemplary embodiment.

According to an exemplary embodiment shown in FIGS. 1 through 3, ribs 26 are integrally formed as part of surface 21 (e.g., formed out of the same mold). As shown in FIGS. 1 through 3, ribs 26 are all approximately the same length. It may be desirable to have ribs as thin as possible, while still maintaining maximum durability. According to alternative embodiments, the ribs may be varied (e.g., length) to accommodate for other parts of the shelf assembly or merchandising system. The width and the height of the ribs may be varied and are not necessarily continuous along the length of the surface of the base. For example, the ribs may include breaks or may vary in shape and/or height at different locations along their length. As best shown in FIG. 1, ribs 26 may have a rounded surface. According to alternative embodiments, the shape of the surface (e.g., profile) of the ribs may vary. For example, the surface of the ribs may be rectangular, curved, triangular, ridged, wavy, etc. or any other friction reducing shape. According to another alternative embodiment, a separate piece or mat that includes the ribs may be attached to the surface of the base to achieve the same result. The number of ribs may vary according to the particular needs associated with each shelf assembly or the overall merchandising system. According to various exemplary embodiments, the size, shape, number, form, and/or configuration of the ribs may vary.

According to an exemplary embodiment shown in FIGS. 1 through 3, surface 21 may include ribs 26 that lie parallel to one another. Referring to FIG. 3, ribs 26 lie adjacent and parallel to centrally disposed track 70. Each of ribs 26 acts to reduce the amount of drag of product when loaded/unloaded from base 20. A small number of ribs (e.g., 2 or less) may result in too much weight being placed on the base or the ribs whereas a larger number of ribs (e.g., 6 to 12) may distribute the weight more effectively, thereby requiring less tension and force from a biasing mechanism (e.g., assembly 50). This allows for easier loading/unloading of the merchandising system.

The ribs may be made from any of a variety of materials. According to an exemplary embodiment, the ribs are made from a plastic material. According to exemplary embodiments, the ribs may be made from styrene, polypropylene, polycarbonate, ester, etc. or any other suitable material According to various exemplary embodiments, one or more base (e.g., tray system) may be provided. The base may be provided on an existing merchandising system such as a shelf, grid system, display case, etc. The base may be configured to hold, display, retain, store, or otherwise receive articles (e.g., goods, displayed objects, etc.). The base provides for the space division and orderly and convenient presentation of such articles. The base may be configured to connect or couple adjacent systems into a larger overall merchandising system. According to a preferred embodiment, the base will have a "modular" construction and be configured for attachment or use with any other bases, shelves, or a variety of other existing merchandising systems, including shelving units, support surfaces, grids, brackets, hangers, etc.

Figure 4:
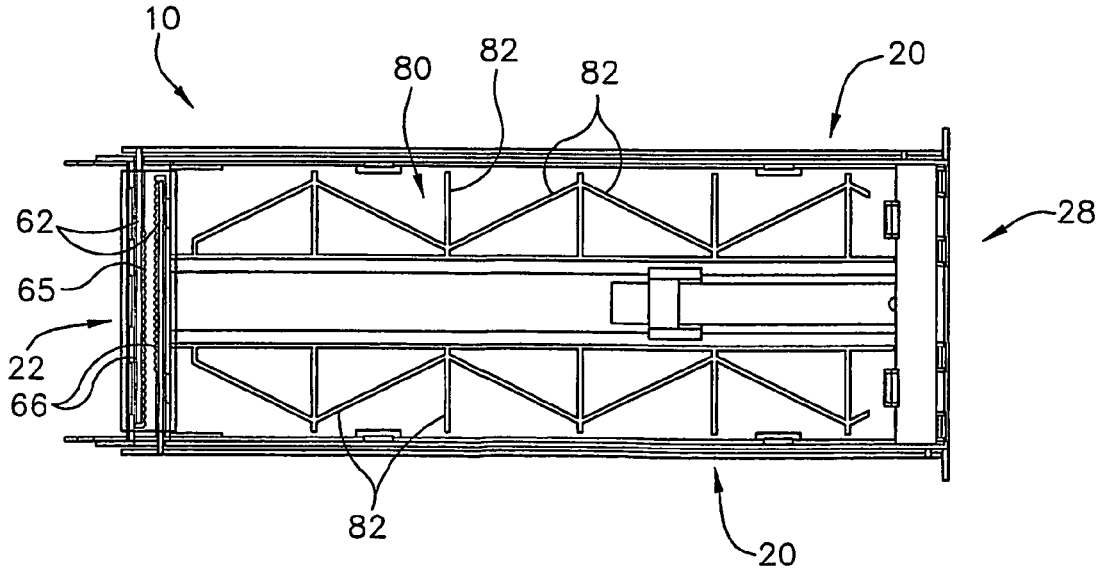
FIG. 4 is a bottom plan view of a merchandising system according to an exemplary embodiment.

According to an exemplary embodiment, base 20 may comprise a frame shown as a structure 80 (e.g., truss, truss mechanism, supports, support system, bracing, frame, etc.). Structure 80 may comprise one or more truss members 82 (e.g., beams, cross-bars, cross-members, joists, girders, braces, cross-pieces, etc.). According to an exemplary embodiment shown in FIG. 4, a certain number of truss members 82 lay in a diagonal or intersecting pattern along the underside or lower surface of base 20. A number of truss members 82 lay substantially perpendicular to track 70 and intersect with the diagonal truss members 82. In general, the truss members work to improve stability and reduce deflection of the tray when loaded with articles and product. Fewer truss members can increase the likelihood of weakened stability of the tray and can result in sagging (or deflection/bending) of the tray. Having more truss members helps keep the tray as constant as possible relative to adjacent trays. The truss members provided on the base assist in strengthening and/or rigidifying the merchandising system to resist sagging or deformation. This results in the display, storage, and/or presentation of products in the trays/systems being relatively more neat, orderly, linear, straight, etc.

According to alternative embodiments, other types or formations of truss members for supporting the merchandise system may be used. For example, the truss members do not have to intersect or cross each other diagonally. Instead, each truss member may lie parallel to the others or may have curved shapes. Other shapes are also contemplated, including L-shape, C-shape, U-shape, round shape, etc. Similarly, the number of truss members or other features may vary according to the particular needs associated with each shelf assembly or the overall merchandising system. The truss members may be formed integrally within the base instead of on an undersurface of the base. Likewise, the truss members could also be attached for support to the upper surface of the base.

According to an exemplary embodiment, truss members 82 are integrally formed as part of the base. According to alternative embodiments, the truss members may be fastened (e.g., mounted, coupled, attached, etc.) by a particular means, such as welding, adhesives, mechanical fasteners, etc.

According to an exemplary embodiment, one or more guides 40 for holding articles and product in the tray may be provided along each side of base 20. As shown in FIGS. 1, 2, 5, and 6, a first guide 42 and a second guide 44 are provided. Guides 40 help keep product aligned in the tray and eliminate overlap of product with adjacent trays. According to various exemplary embodiments, the height of each guide may vary depending on the particular needs associated with each tray or the overall merchandising system.

According to an exemplary embodiment, first guide 42 and second guide 44 may extend an equal distance out from the edges of each side of the base 20. According to various alternative embodiments, the guides may extend varying distances from each side of the base. For example, one guide may extend several inches from a side of the base whereas the other guide may extend less than one inch from the other side of the base. According to an exemplary embodiment shown in FIGS. 1, 2, 7, and 8, each guide 40 includes an insertion portion 62 that may be inserted into channels 66 (e.g., grooves, apertures, etc.) on base 20. This way, the width of the tray may be adjusted (e.g., how far apart the guides are) by inserting each insertion portion 62 into a corresponding channel 66 on base 20. Channels 66 may include ridges 65 (e.g., ribs, bumps, etc.) along their length to provide force (e.g., resistance to removal of the guides or a gripping force) to guides 40. For example, ridges 65 may act as "teeth" and help prevent each guide 40 from being removed from channels 66.

Figure 7:
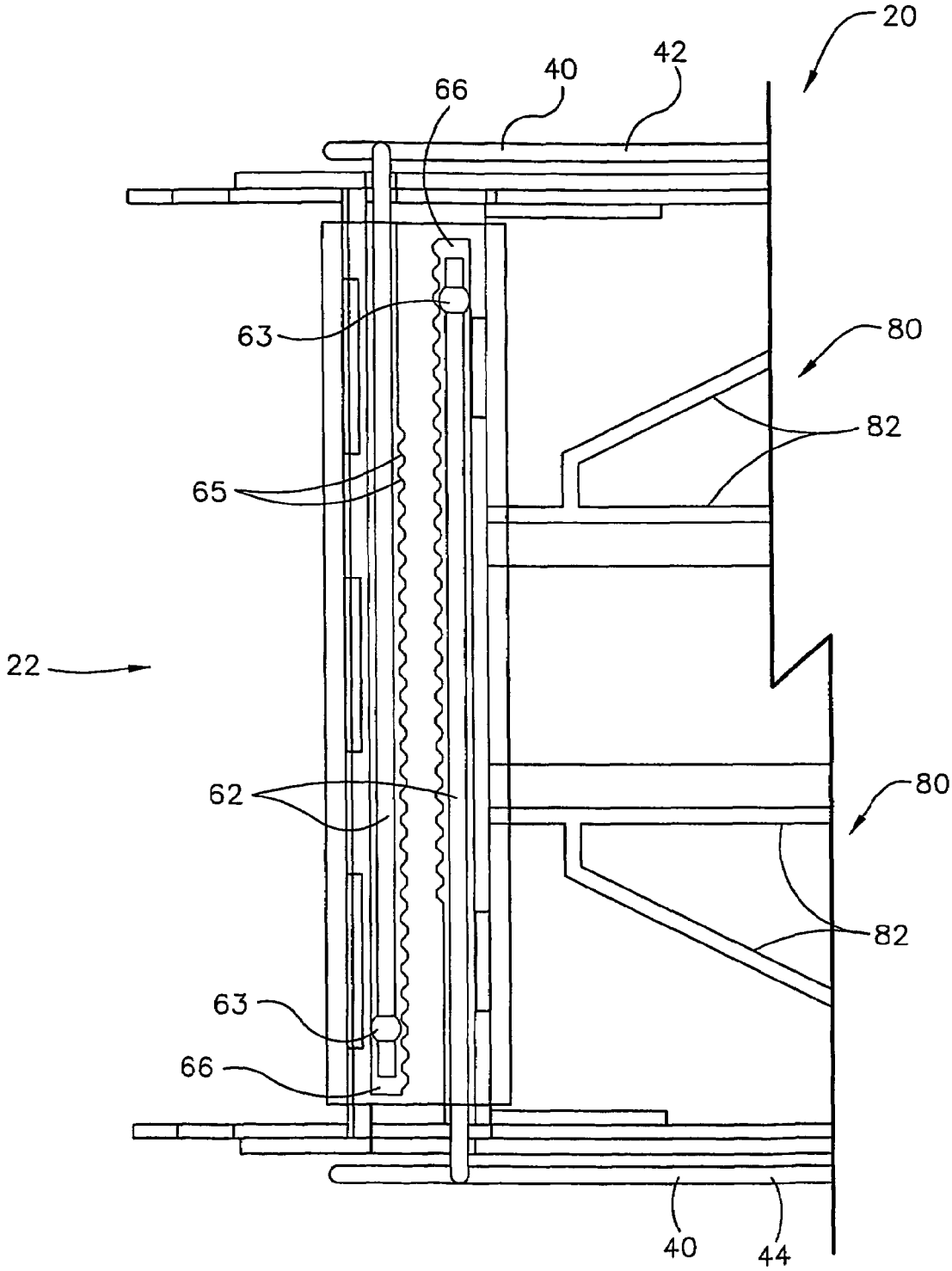
FIG. 7 is a partial bottom view of the guide coupled to the base of the merchandising system according to an exemplary embodiment.
Figure 8:
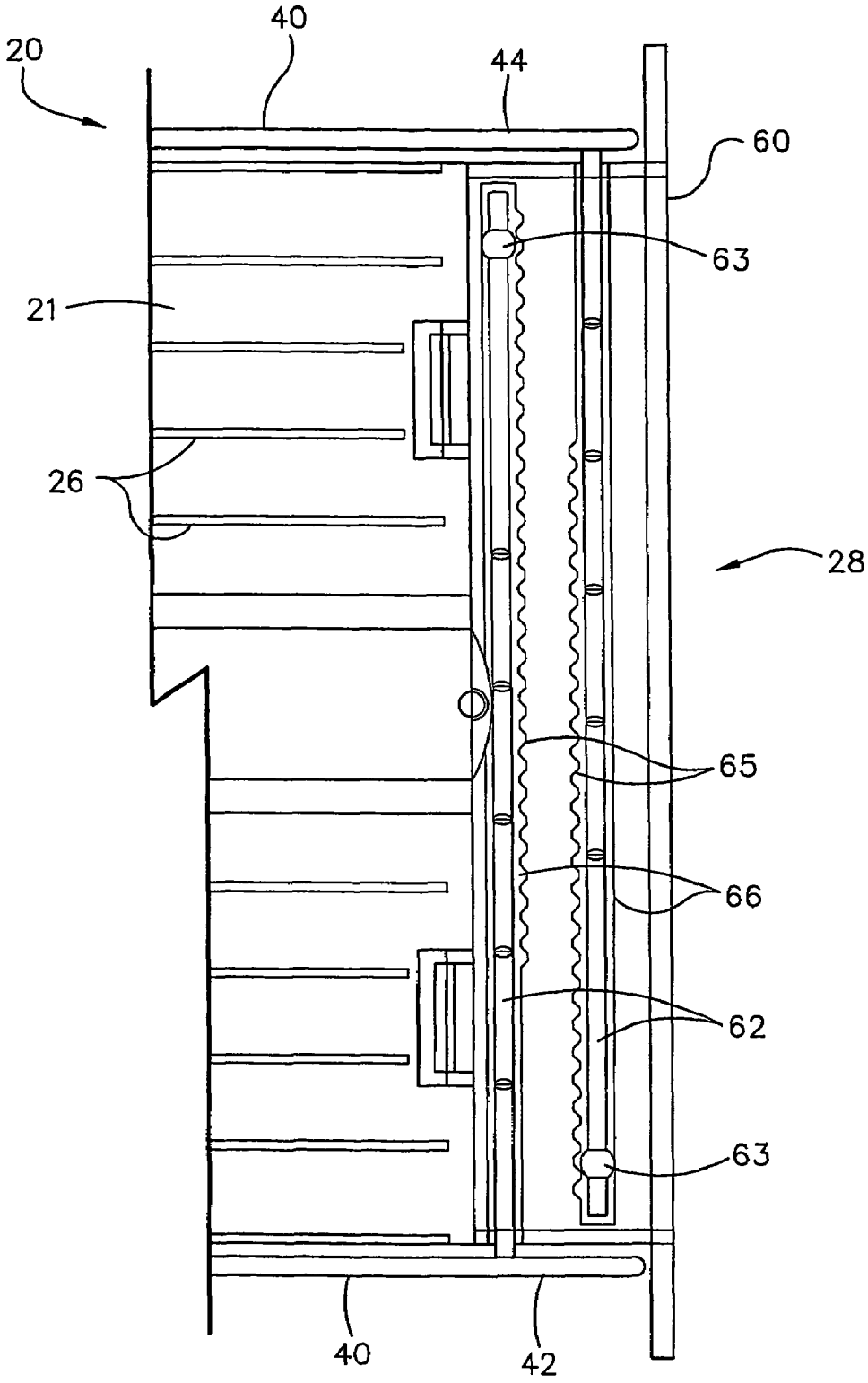
FIG. 8 is a partial top view of the guide coupled to the base of the merchandising system according to an exemplary embodiment.

To increase gripping between insertion portions 62 and channels 66, insertion portions 62 may include couplers 63 that are configured to secure insertion portions 62 within channels 66. For example, as shown in FIGS. 7 and 8, couplers 63 are rounded circular protrusions that fit between ridges 65 and releasably lock insertion portions 62 within channels 66. The insertion portions 62 may be moved inside channels 66 to position couplers 63 in corresponding ridges 65. According to various alternative embodiments, the couplers may be any suitable shape and/or configuration (e.g., rectangular, ridged, triangular, etc.). Once insertion portions 62 are suitably positioned in channels 66, lens and wire connectors 34 (e.g., couplers, fasteners, etc.) shown in FIG. 2 may be used to couple the guides to base 20. Because of the different angles at the upper corners of guides 40 (as described below), the insertion portions at front end 28 of base 20 may be proximate to one another (e.g., one closer to the front end of the base), and the insertion portions at rear end 22 of base 20 may be proximate to one another (e.g., one closer to the rear end of the base). According to various alternative embodiments, any number of means of coupling the guides to the base may be used (e.g., screws, clasps, hinges, adhesives, etc.).

Figure 5:
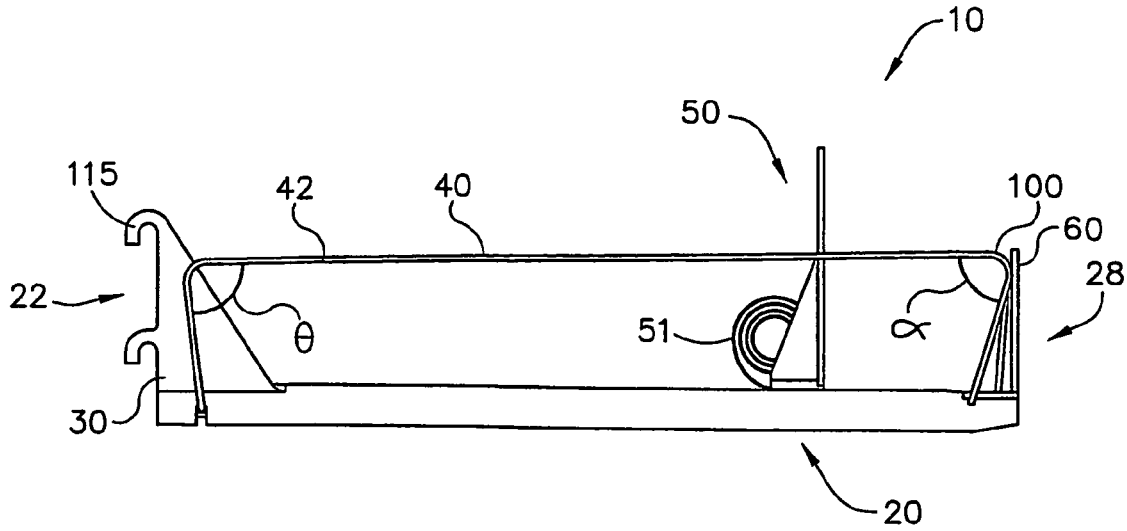
FIG. 5 is a side plan view of a merchandising system according to an exemplary embodiment.
Figure 6:
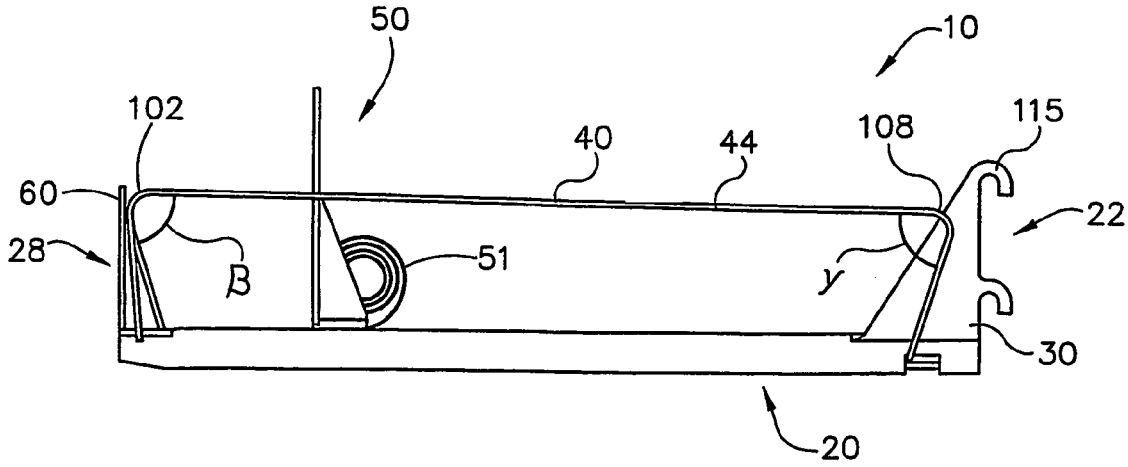
FIG. 6 is a side plan view of a merchandising system according to an exemplary embodiment.
Figure 9:
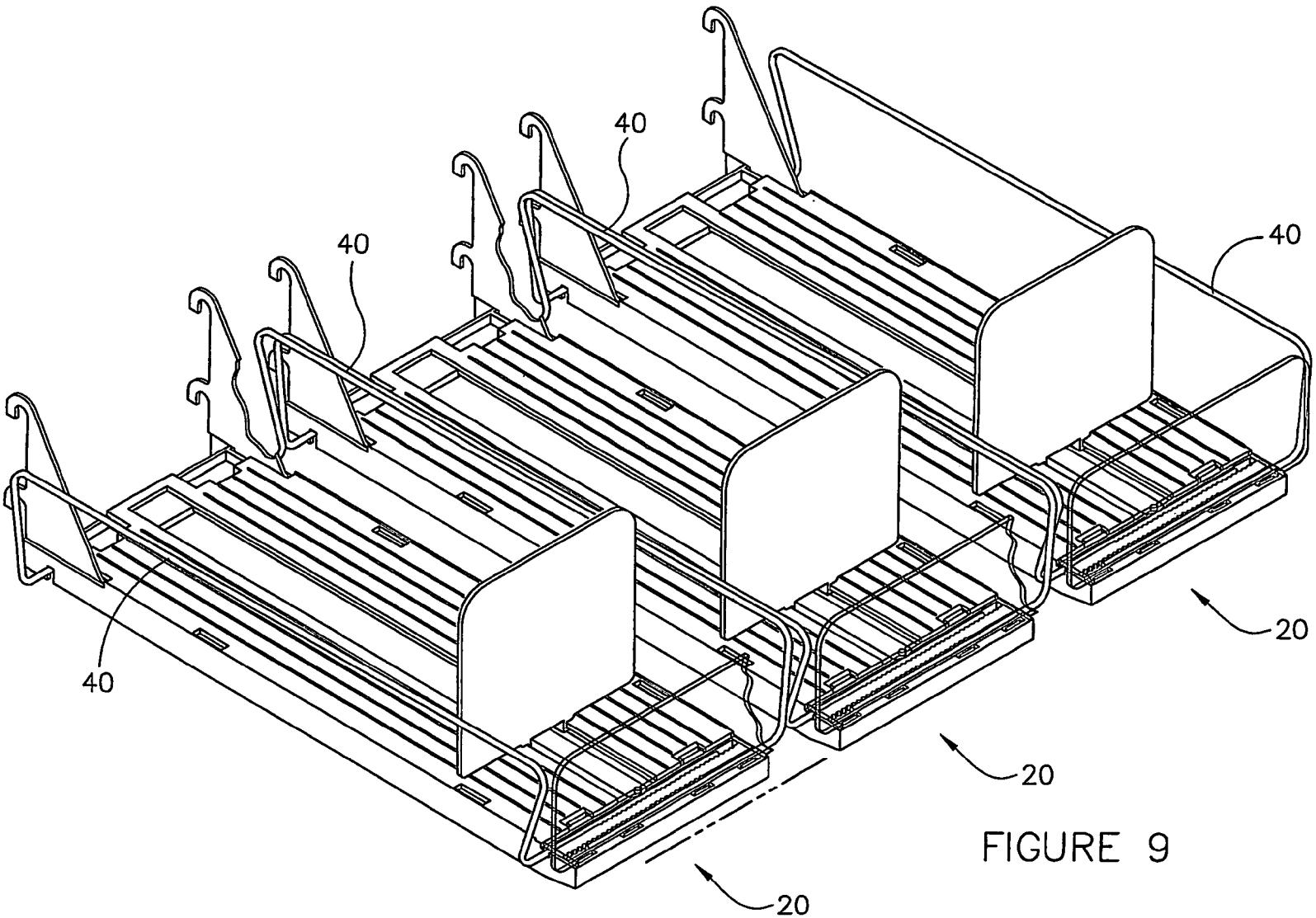
FIG. 9 is a front perspective view of a plurality of merchandising systems positioned side-by-side according to an exemplary embodiment.

According to an exemplary embodiment shown in FIGS. 1, 5, and 6, a front upper corner 100 of first guide 42 has an angle $\alpha$ that is less than (but not equal to) an angle $\beta$ of a front upper corner 102 of second guide 44. According to various alternative embodiments, angle $\alpha$ may be greater than (but not equal to) angle $\beta$. Similarly, a rear upper corner 106 of first guide 42 has an angle $\theta$ that is greater than (but not equal to) an angle $\gamma$ of rear upper corner 108 of second guide 44. These configurations discourage any overlap of guides with adjacent trays. For example, if angle $\alpha$ and angle $\beta$ were equal, it would be easier for one corner portion of the guide to become tangled with an adjacent corner portion since each corner would be complementary in shape. As shown in FIG. 9, a plurality of trays are positioned side-by-side to show how the different angles at each corner of the guides help prevent overlap of the guides, and thereby discourage tangling of the guides and trays.

According to an exemplary embodiment, first guide 42 and second guide 44 may be manufactured identically so that on each guide, one upper corner angle is larger than the other upper corner angle. That way, both the first guide and the second guide have the same overall shape and configuration. However, once the guides are coupled to the base, one guide has a reversed orientation with respect to the other guide, resulting in different angles $\alpha$ and $\beta$ at the front end of the base and different angles $\theta$ and $\gamma$ at the rear end of the base. According to an exemplary embodiment, angle $\alpha$ (and angle $\gamma$) is about 50 to 90 degrees with respect to a plane extending generally parallel to the base. According to a preferred embodiment, angle $\alpha$ (and angle $\gamma$) is about 65 to 80 degrees. According to various exemplary embodiments, angle $\beta$ (and angle $\theta$) is either less than or greater than angle $\alpha$ (and angle $\gamma$). For example, if angle $\alpha$ (and angle $\gamma$) is 72 degrees, then angle $\beta$ (and angle $\theta$) may be 80 degrees. According to alternative embodiments, the number, size, position, angle and overall orientation of the guides may vary. For example, any number of guides may be used (e.g., 1, 3, 4, 8, etc.).

Base 20 may also be provided with at least one track 70 (e.g., guide, notch, groove, recess, slot, etc.). Track 70 may extend substantially along the length of base 20. According to an exemplary embodiment, base 20 may include a support (e.g., bar, clip, fastener, etc.) that adheres to the bottom of the base on both sides of track 70 to prevent track 70 from being spread apart as member 52 moves along base 20. The support may be permanently coupled to base 20 to provide support to track 70. For example, the support may include tabs which "clip" into apertures located on base 20 and an adhesive bond may be applied to keep the support "locked" in place. According to alternative embodiments, a support may be removably coupled to base 20.

According to various alternative embodiments, the configuration of the base may be altered to better accommodate the shape of the articles (e.g., the base may have a circular, rectangular, triangular or polygonal cross-section, the base may have a non-uniform configuration throughout, etc.). For example, the guides may comprise multiple members positioned in multiple orientations or positions.

According to an exemplary embodiment, system 10 includes assembly 50 for advancing articles toward front end 28 of base 20. Assembly 50 may include biasing mechanism 51 (e.g., spring, coil spring, helical spring, elastic, etc.) to urge or bias member 52. Member 52 (e.g., paddle, movable panel, scoop, pusher, plate, follower, etc.) is preferably slidably engaged to base 20. As shown in FIG. 1, member 52 is slidably engaged to track 70 of base 20. According to an exemplary embodiment, member 52 may be constructed as a single unit. In an alternative embodiment, member 52 may be provided as an assembly of two or more elements.

As shown in FIGS. 2, 5, 6, 13A and 13B, biasing mechanism 51 may be a coil spring with a first end attached to front end 28 of base 20 and a second end coacting with member 52. When member 52 is near front end 28 of base 20, biasing mechanism 51 is at least partially relaxed. As member 52 is moved away from front end 28 of base 20, the tension in biasing mechanism 51 is increased. According to an alternative embodiment, the coil spring can be replaced with any other suitable biasing mechanism. In alternative embodiments, the biasing mechanism may be, but is not limited to, a spring, helical spring, elastic, etc.

Figure 13A:
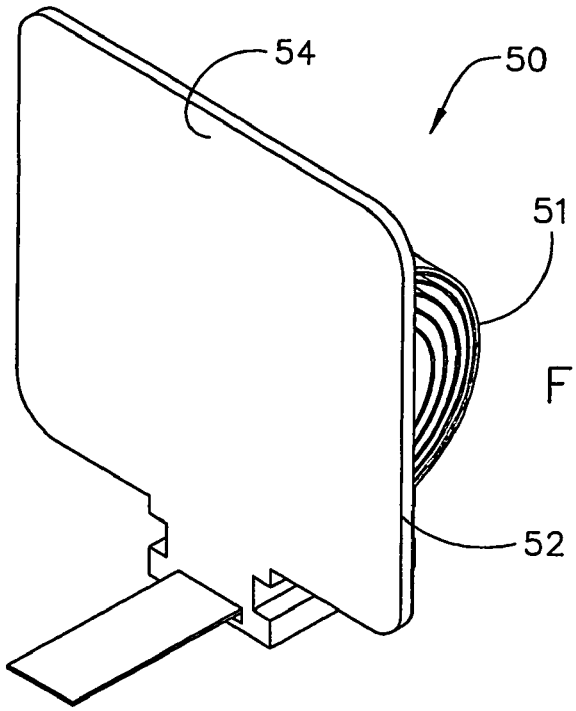
FIG. 13A is a front perspective view of a biasing mechanism according to an exemplary embodiment.

As shown in FIG. 13A, member 52 includes back portion 54 that is provided in a substantially vertical orientation. As shown in FIGS. 1, 5, 6, and 9, back portion 54 is positioned perpendicular to base 20. Back portion 54, as shown in FIG. 13A, may be rectangular in shape. According to alternative embodiments, the back portion may be circular, scoop-shaped, triangular, trapezoidal, fork-shaped, etc. Member 52 may be configured to slidably engage with base 20. For example, member 52 may be configured to slidably engage with track 70 extending substantially the length of base 20. Member 52 may be configured to support articles such as product. Member 52 may also be configured to interact with biasing mechanism 51. In some embodiments, the shape of the member may be fork-shaped. In other embodiments, the shape of the member may be rectangular, scoop-shaped, circular, triangular, trapezoidal, etc.

Member 52 may be provided with tabs (e.g., projections, pegs, etc.) which may be configured to coact or engage with track 70 of base 20. Member 52 may also be configured with a platform (tab, ledge, member, shelf, etc.) that may provide support for biasing mechanism 51. The platform may also guide biasing mechanism 51 during the movement of member 52.

Figure 13B:
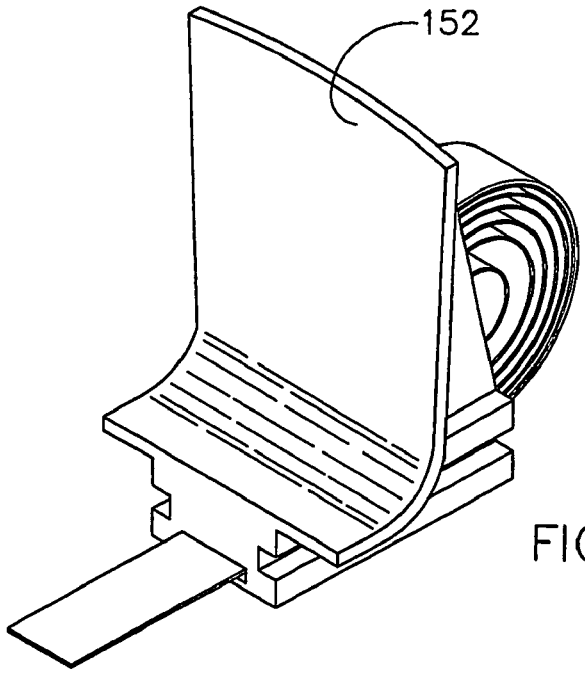
FIG. 13B is a front perspective view of a biasing mechanism according to an alternative embodiment.

According to various alternative embodiments, the member (e.g., pusher) may have a wide variety of shapes and/or configurations. As shown in FIG. 13B, member 152 may have a curved shape (e.g., curved, scoop, shovel-like, cup-like, bucket-like, etc.). Providing a member with a curved shape may better accommodate certain shapes of articles. For example, the curved shape may better accommodate a bag of articles (such as chips, salty-snacks, etc.) while a member of another shape (e.g., rectangular) may better accommodate a more fixed or rigid article (such as boxed products, etc.). According to an alternative embodiment, the member located on a base may be provided with one or more apertures (e.g., cut-outs, reliefs, holes, etc.). The one or more apertures may advantageously reduce the amount of material needed to build and/or construct the member, or alternatively reduce the weight of the member.

As shown in the FIGURES, plate 60 (e.g., panel, member, wall, lens, window, etc.) may be provided along front end 28 of base 20. Plate 60 may be provided in a substantially vertical orientation. Portions 62 (e.g., fingers, tabs, projections, connectors, etc.) of plate 60 may be configured to couple with apertures 64 of base 20. According to a particularly preferred embodiment, plate 60 engages with the corresponding portions of base 20 by a "snap-fit." Plate 60 may be rectangular, circular, octagonal, trapezoidal, etc. in shape and may be of any size or configuration sufficient to retain the article as a force is being applied to the article by the member. According to alternative embodiments, plate 60 may be an integral piece with the base and/or sides.

Plate 60 may be configured to receive or display indicia (e.g. text, graphics, display placards, signage, etc.). For example, indicia may be applied directly to plate 60. According to an alternative embodiment, the plate may comprise one or more channels configured to hold and display indicia. The plate may be clear to increase visibility of the merchandising articles. This configuration allows the articles to be readily visible by minimizing the potential obstruction that could be created by a front wall. According to an exemplary embodiment, the visibility of the articles may be maximized by providing a clear or transparent plate.

Figure 11:
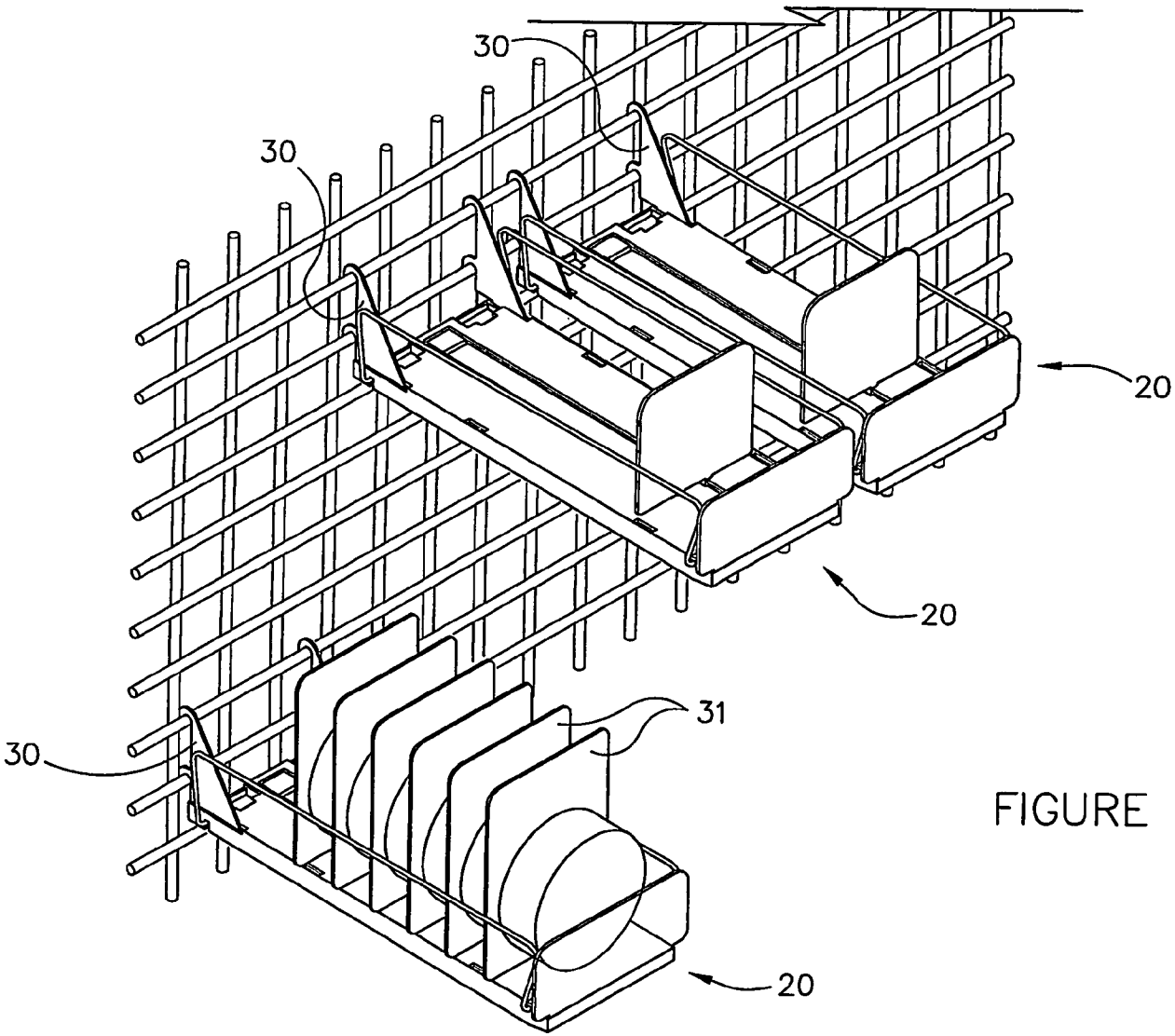
FIG. 11 is a perspective view of merchandising systems coupled to a frame according to an exemplary embodiment.
Figure 12A:
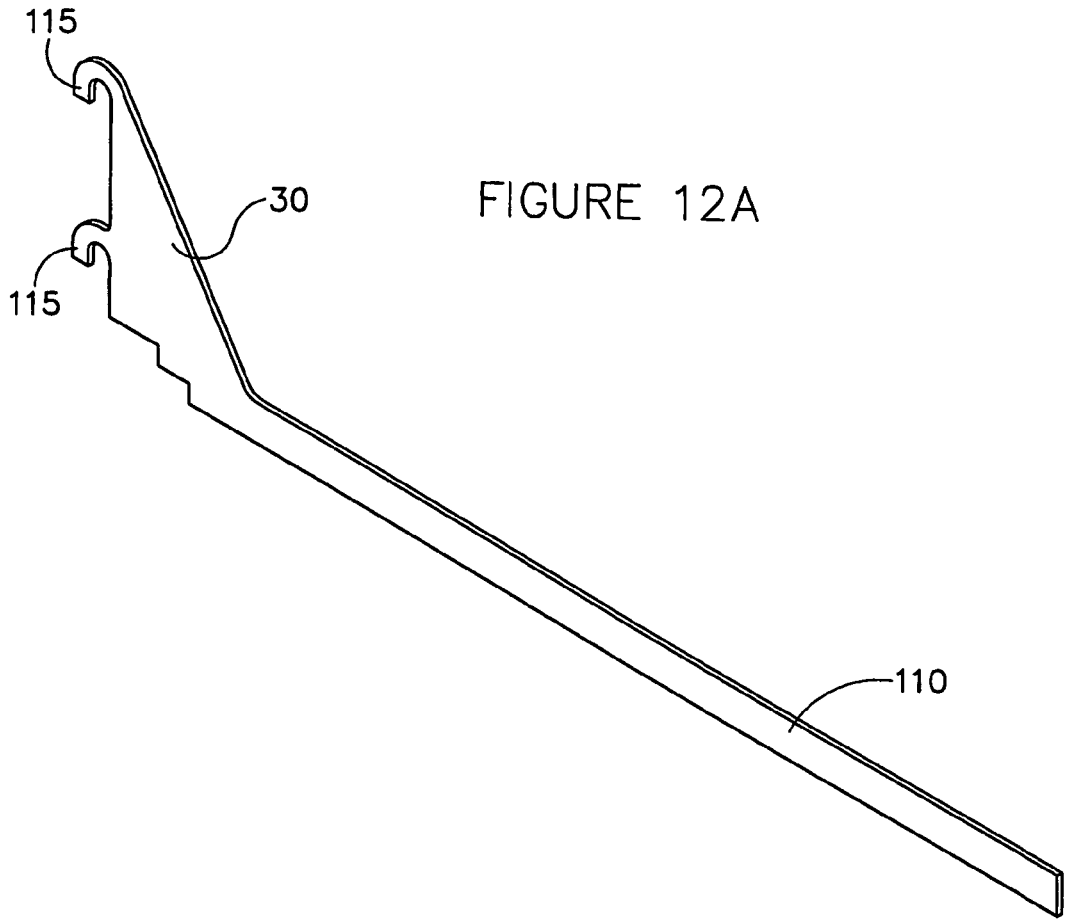
FIG. 12A is a front perspective view of a support according to an exemplary embodiment.
Figure 12B:
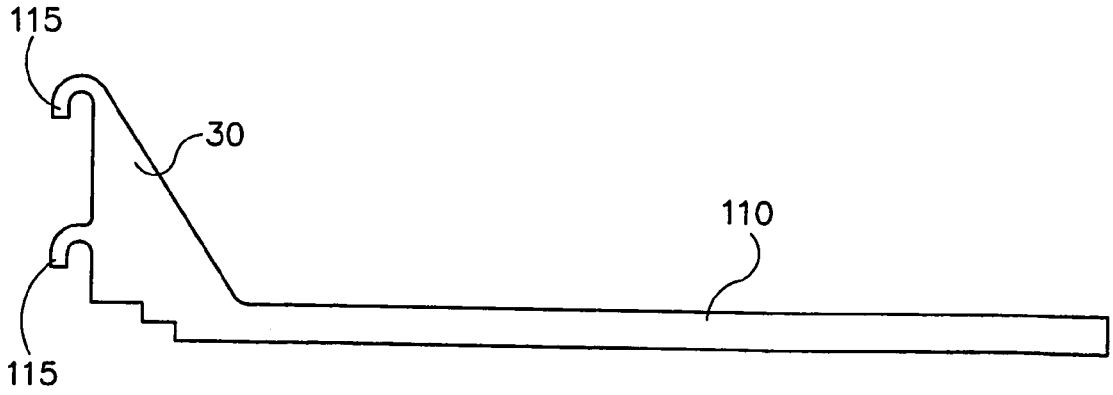
FIG. 12B is a side view of the support according to an exemplary embodiment.

According to an exemplary embodiment as shown in FIG. 2, base 20 may include supports 30. Supports 30 may be configured to attach to a framework or base having vertical braces. Supports 30 may have one or more interfaces (e.g., hooks, notches, projections, connectors, couplers, mounts, etc.) that couple to the framework or base. For example, the supports may include hooks 115 as shown in FIGS. 12A and 12B for removable attachment with horizontal bars or grid (as shown in FIG. 11). This configuration allows the base to be moved (vertically and horizontally) to various locations depending on the type of article. Supports 30 may also include extended portions 110 that couple to the base along the underside of the base. Extended portions 110 provide additional support for the tray by providing a strong, substantially rigid brace for base 20. According to an exemplary embodiment, extended portions 110 of supports 30 may be coupled to an inner side of edges 90. According to various alternative embodiments, extended portions 110 may be coupled to any part of base 20 or system 10. For example, the extended portions may be coupled to a bottom surface of the base. The number of extended portions may vary according to the particular needs associated with the system. The number of supports may also vary, including the number of projections (shown as hooks). The supports should preferably be made from a durable, strong and/or rigid material.

According to an exemplary embodiment, one or more fasteners (e.g., mechanical fasteners, adhesives, suction cups, rubber feet, bolts, VELCRO™, brackets, etc.) may be provided on the bottom of the merchandising system to hold, retain, etc. the merchandising system in place. The fasteners may be non-skid rubber feet provided on the underside of the merchandising system (e.g., provided on the ends of the base). Slots may be provided on the underside of the merchandising system to receive the non-skid rubber feet. The non-skid rubber feet may adhere or otherwise coact with a surface (such as a display shelf). According to alternative embodiments, the fasteners may be made from any other suitable material. According to alternative embodiments, fasteners may be omitted.

According to various exemplary embodiments, the assemblies and components of the merchandising system may be constructed from extruded or injection molded plastic. A variety of plastics may be used for construction or assembly. For example, the base may be constructed or assembled from high-impact plastics, polymers, etc. Using plastic offers several advantages including that the pieces may be constructed in a variety of different colors, surface finishes, textures, opacity, etc. According to various alternative embodiments, a variety of other known or suitable materials may be used, including metals, alloys, composites, etc. For example, the guides may be constructed from metal.

According to the various exemplary embodiments shown in the FIGURES, a merchandising system may be provided on a substantially horizontal surface such as a display shelf or may be provided as the substantially horizontal surface of a display shelf merchandising system. According to alternative embodiments, the elements and the assemblies of the various exemplary embodiments may be applied to a merchandising system provided at any orientation and are not limited to a substantially horizontal surface. The exemplary embodiments shown in the FIGURES may be dimensioned to fit any applicable merchandising system (e.g. shelf, display, grid, etc.). For example, the exemplary embodiments advantageously allow a single merchandising system to be used interchangeably with display shelf merchandising systems of different depths without limiting the storage capacity of the merchandising system to the storage capacity of the smallest merchandising shelf system by providing an enlargeable storage space.

The merchandising system may be incorporated into a display shelf system so that the front end of the merchandising system is near the front edge of a display shelf system. Articles may be placed in the space (e.g., storage space, compartment, bin, holder, etc.) of the merchandising system defined by the base surface, the guides, and the plate.

The parts defining the space configured to store or display articles may be constructed and assembled as a single integrally formed piece or may be constructed and assembled from multiple parts. The parts may be arranged to form a storage space. Before an article is placed in the space of the merchandising system, the member may be positioned near the front wall. With the member positioned near the front of the wall, the size of the space available to accept articles is minimal. The biasing mechanism positions the member near the front wall of the merchandising system when no articles are loaded in the merchandising system.

Referring to FIG. 1, the merchandising system may be initially loaded with articles by either manually positioning member 52 toward rear end 22 of base 20 and then loading the articles into the expanded space, or by loading the articles at front end 28 and having the articles move member 52 towards rear end 22 of base 20 as more articles are added to the space. As articles are loaded and member 52 is moved further from front end 28, the tension force in the biasing mechanism may increase. The tension developed in the biasing mechanism may cause member 52 to apply a force to the articles in the merchandising system. The force applied by member 52 may securably contain the articles within space 29. Additionally, the force applied to the articles positions or urges the articles toward front end 28 of the merchandising system. The biasing mechanism may be adjusted or configured so that the force applied to the articles by member 52 does not damage the articles.

Once loaded with articles, the merchandising system advantageously allows for the forward movement of the articles after an article is removed. When an article is removed from the front of the merchandising system, the remaining articles are positioned forward by the biasing mechanism to fill the void left by the removed article. Moving the remaining articles to the front of the merchandising system maximizes the visibility of the articles by eliminating the possibility that adjacent articles positioned near the edge of the display shelf system could obstruct the view of an article set back from the edge of the display shelf system. Additionally, the movement of the article to the front of the merchandising system reduces the difficulty of trying to reach an article positioned away from the front edge of a display shelf system. Furthermore, the forward movement also eliminates the need to manually reposition all of the remaining articles in the merchandising system after an article has been removed.

Referring to FIGS. 1, 2, 5, 6, and 7, guides 40 of the merchandising system may retain the articles when the articles are stored or presented in the merchandising system. Guides 40 may guide the article as the article is positioned or urged in the merchandising system by member 52. Plate 60 may prevent the articles from being urged off the front of the merchandising system. When member 52 positions or urges the articles toward the front of the merchandising system, plate 60 may retain the articles in the merchandising system. According to an alternative embodiment, the merchandising system may be configured so that a front wall plate is not needed to retain the urged article (e.g., an additional member may be added, the configuration of the base and/or side wall may sufficiently retain the article, the angle of the merchandising system, etc.).

According to a preferred embodiment in which the biasing mechanism is a coil spring, the member may provide at least one platform to support the coil spring. When the member is positioned near the front wall of the merchandising system, the portion of the coil spring that is uncoiled may be minimal. The platform may support the coiled portion of the spring and may further act as a guide for the coiled spring by preventing the coiled spring from interfering with the merchandising system during the movement of the member.

The technique used to initially load the merchandising system may be used to reload the merchandising system as articles are removed. In a particularly preferred mode of operation, the new article is reloaded from the front of the merchandising system as it remains incorporated with the display shelf system.

The various embodiments of the merchandising system shown in the FIGURES may advantageously allow for individual merchandising systems to be positioned adjacently or stacked vertically (e.g., using connectors), providing for selective modularity in the construction and assembly of the merchandising system. According to alternative embodiments, adjacent systems may be coupled to each other with a variety of fasteners, including dovetails, screws, bolts, adhesives, joints, etc.

According to various exemplary embodiments, the assemblies and components of the system may be constructed from a variety of suitable materials, including extruded or injection molded plastic, metals, metal alloys, aluminum, polymers, composites, ceramics, etc. A variety of plastics may be used for construction or assembly. For example, the base and the plate may be constructed or assembled from high-impact plastics, polymers, etc. Using plastic offers several advantages including that the pieces may be constructed in a variety of different colors, surface finishes, textures, opacity, etc. According to various alternative embodiments, a variety of other known or suitable materials may be used, including metals, alloys, composites, etc. Various parts of the system may be constructed and assembled as a single integrally formed piece or may be constructed and assembled from multiple parts.

It is important to note that the above-described preferred embodiments are illustrative only. Although the invention has been described in conjunction with specific embodiments thereof, those skilled in the art will appreciate that numerous modifications are possible without materially departing from the novel teachings and advantages of the subject matter described herein. Accordingly, these and all other such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangements of the preferred and other exemplary embodiments without departing from the spirit of the present invention.

What is claimed is:

1. A merchandising system for articles comprising:

a base comprising an upper surface having a plurality of ribs, an underside having a plurality of supports formed integrally with the underside of the base, and a first side and a second side;

a frame coupled to the base and configured to couple with a shelving system for supporting the base in a substantially horizontal configuration;

a first guide and a second guide coupled to the base for supporting articles; and an assembly for advancing the articles that is coupled to the base and provides force on the articles;

wherein the first guide is positioned along the first side of the base and the second guide is positioned along the second side of the base and the first guide includes a first insertion portion and a second insertion portion and the second guide includes a third insertion portion and a fourth insertion portion; and wherein the upper surface of the base comprises channels located proximate a front end of the base and the underside of the base comprises channels located proximate a rear end of the base and the first and third insertion portions are inserted into channels adjacent the front end of the base and the second and fourth insertion portions are inserted within the channels adjacent the rear of the base.

2. The merchandising system of claim 1 wherein the channels comprise ridges for resisting insertion and removal of the insertion portions.

3. The merchandising system of claim 2 wherein the insertion portions comprise couplers for engaging the ridges of the channels.

4. The merchandising system of claim 3 wherein the couplers are rounded and configured to at least partially fit between the ridges of the channels.

5. The merchandising system of claim 4 wherein the first guide comprises a first corner having an angle and the second guide comprises a first corner having an angle.

6. The merchandising system of claim 5 wherein the angle of the first corner of the first guide is not equal to the angle of the first corner of the second guide.

7. The merchandising system of claim 6 wherein the first guide comprises a second corner having an angle and the second guide comprises a second corner having an angle.

8. The merchandising system of claim 7 wherein the angle of the second corner of the first guide is not equal to the angle of the second corner of the second guide.

9. The merchandising system of claim 8 wherein the angle of the first corner of the first guide is in the range of about 50 to 90 degrees with respect to a plane extending generally parallel to the base.

10. The merchandising system of claim 1 wherein the ribs comprise a profile that is generally semi-circular and is configured to reduce friction when sliding the article along the ribs.

11. The merchandising system of claim 1 wherein the plurality of supports comprise a truss having truss members.

12. The merchandising system of claim 11 wherein at least two truss members intersect and at least one truss member lies substantially perpendicular to a track located on the base and intersects at least one truss member that lies diagonal to the track.

13. The merchandising system of claim 1 wherein the frame comprises a first frame and a second frame coupled to the underside of the base, the first frame comprising a first interface and the second frame comprising a second interface, the first interface and the second interface being configured to removably couple to a shelving system.

14. A merchandising system for articles comprising:

a base comprising an upper surface, a first side and a second side;

a frame coupled to the base and having a first interface and a second interface that are configured to couple with a shelving system for supporting the base in a substantially horizontal configuration;

a first guide and a second guide coupled to the base for supporting articles; and an assembly for advancing articles that is coupled to the base and provides force on the articles;

wherein the first guide comprises a first corner having an angle and the second guide comprises a first corner having an angle;

and wherein the angle of the first corner of the first guide is not equal to the angle of the first corner of the second guide;

the first and second guides each including front and rear insertion portions for coupling to the base, the front insertion portions of the guides each inserted into a channel in the upper surface of the base and the rear insertion portions of the guides each inserted into a channel under the upper surface of the base.

15. The merchandising system of claim 14 wherein the first guide comprises a second corner having an angle and the second guide comprises a second corner having an angle.

16. The merchandising system of claim 15 wherein the angle of the second corner of the first guide is not equal to the angle of the second corner of the second guide.

17. The merchandising system of claim 16 wherein the first guide and the second guide comprise insertion portions and the base comprises channels and wherein the insertion portions are inserted into the channels of the base to couple the base to the first guide and the second guide.

18. A merchandising system for articles comprising:

a base comprising an upper surface having a plurality of ribs and an under surface having a plurality of supports formed integrally with the under surface of the base;

a frame coupled to the base and having a first interface and a second interface that are configured to couple with a shelving system for supporting the base in a substantially horizontal configuration;

sides coupled to the base for supporting articles; and an assembly for advancing articles that is coupled to the base and provides force on the articles;

wherein a first side is positioned along a first side of the base and a second side is positioned along a second side of the base and the first side includes a first insertion portion and a second insertion portion and the second side includes a third insertion portion and a fourth insertion portion; and wherein the base comprises channels located proximate the upper surface adjacent a front end of the base and channels located proximate the lower surface adjacent a rear end of the base and the first and third insertion portions are inserted into channels adjacent the front end of the base and the second and fourth insertion portions are inserted within the channels adjacent the rear of the base.

19. The merchandising system of claim 18 wherein the plurality of ribs lie adjacent and substantially parallel to one another.

20. The merchandising system of claim 19 wherein the plurality of supports comprise truss members and wherein at least two truss members intersect in a diagonal pattern and at least one truss member is substantially perpendicular to a track located on the base.

21. The merchandising system of claim 20 wherein the shelving system comprises a grid and the first interface and the second interface are configured to removably couple to the grid so that the base may be coupled to the grid at multiple locations.

* * * * *